US005927154A

United States Patent [19]

Elton et al.

[11] Patent Number: 5,927,154

[45] Date of Patent: Jul. 27, 1999

[54] ADJUSTABLE BRAKE AND CLUTCH PEDALS

[75] Inventors: Robert Douglas Elton, Ann Arbor; Lloyd Walker Rogers, Jr., Shelby Township, Macomb County, both of Mich.

[73] Assignee: General Motors Corporation, Detroit, Mich.

[21] Appl. No.: 09/021,978

[22] Filed: Feb. 11, 1998

[51] Int. Cl.[6] ..... G05G 1/14

[52] U.S. Cl. ..... 74/512; 74/560

[58] Field of Search ..... 74/512, 513, 560

[56] References Cited

U.S. PATENT DOCUMENTS

| | | | |
|---|---|---|---|
| 3,151,499 | 10/1964 | Roe | 74/512 X |
| 3,631,739 | 1/1972 | McArthur . | |
| 3,643,524 | 2/1972 | Herring . | |
| 3,643,525 | 2/1972 | Gibas . | |
| 3,828,625 | 8/1974 | Bruhn, Jr. . | |
| 3,975,972 | 8/1976 | Muhleck . | |
| 4,546,667 | 10/1985 | Bopst, III . | |
| 4,870,871 | 10/1989 | Ivan . | |
| 4,875,385 | 10/1989 | Sitrin . | |
| 5,010,782 | 4/1991 | Asano et al. . | |
| 5,056,742 | 10/1991 | Sakurai . | |
| 5,078,024 | 1/1992 | Cicotte et al. . | |
| 5,086,663 | 2/1992 | Asano et al. . | |
| 5,172,606 | 12/1992 | Dzioba et al. | 74/512 |
| 5,351,573 | 10/1994 | Cicotte . | |
| 5,460,061 | 10/1995 | Redding et al. . | |
| 5,497,677 | 3/1996 | Baumann et al. . | |

*Primary Examiner*—John A. Jeffery
*Assistant Examiner*—Mary Ann Battista
*Attorney, Agent, or Firm*—Kathryn A. Marra

[57] ABSTRACT

An adjustable pedal mechanism for automotive vehicles utilizes a slave lever pivoted on a conventionally located laterally extending front pivot and actuated by a pedal lever on a parallel rear pivot located behind and below the front pivot. The levers are connected by an adjustable link lying generally parallel with the plane of the front and rear pivots to form a parallelogram linkage with the link side being of variable length to vary the initial angular position of a foot pedal at the lower end of the pedal lever. The slave lever connects with an actuator rod for actuating a vehicle device such as a brake or clutch and is applied by forward motion of the foot pedal acting through the pedal lever and adjustable link to the slave lever which moves the actuator rod. The lowered rearward location of the pedal lever allows a greater variation of the pedal position without excessively raising the pedal height while the parallelogram linkage arrangement maintains pedal actuating travel essentially constant at all locations within the range of adjustment positions. A preferred embodiment includes powered adjustment of a ballscrew for adjusting the link.

6 Claims, 3 Drawing Sheets

ADJUSTABLE BRAKE AND CLUTCH PEDALS

TECHNICAL FIELD

This invention relates to adjustable pedals for vehicles and more particularly to an adjustable brake or clutch pedal mechanism with an extended range of adjustment travel.

BACKGROUND OF THE INVENTION

The majority of automotive vehicles currently available are provided with brake and clutch pedals located in relatively fixed positions with a fixed extent of operating motion. They cannot be adjusted closer to or farther away from the driver. A small percentage of vehicles have been offered with adjustable pedals. In general these pedals have shared the same operating axis as the fixed pedals. The adjusting system effectively lengthened or shortened the operating link between the pedal arm and the brake booster or the clutch actuator. These systems have the shortcoming that the pedal is also raised and lowered when adjusted rearward and forward, respectively.

SUMMARY OF THE INVENTION

The present invention provides a solution to these problems by providing an adjustable pedal mechanism for automotive vehicles which utilizes a slave lever pivoted on a conventionally located laterally extending front pivot and actuated by a pedal lever on a parallel rear pivot located behind and below the front pivot. The levers are connected by an adjustable link lying generally parallel with the plane of the front and rear pivots to form a parallelogram linkage with the link side being of variable length to vary the initial angular position of a foot pedal at the lower end of the pedal lever. The slave lever connects with an actuator rod for actuating a vehicle device such as a brake or clutch and is applied by forward motion of the foot pedal acting through the pedal lever and adjustable link to the slave lever which moves the actuator rod. The lowered rearward location of the pedal lever allows a greater variation of the pedal position without excessively raising the pedal height while the parallelogram linkage arrangement maintains pedal actuating travel essentially constant at all locations within the range of adjustment positions.

These and other features and advantages of the invention will be more fully understood from the following description of certain specific embodiments of the invention taken together with the accompanying drawings.

DESCRIPTION OF THE PREFERRED EMBODIMENT

Figure 1:
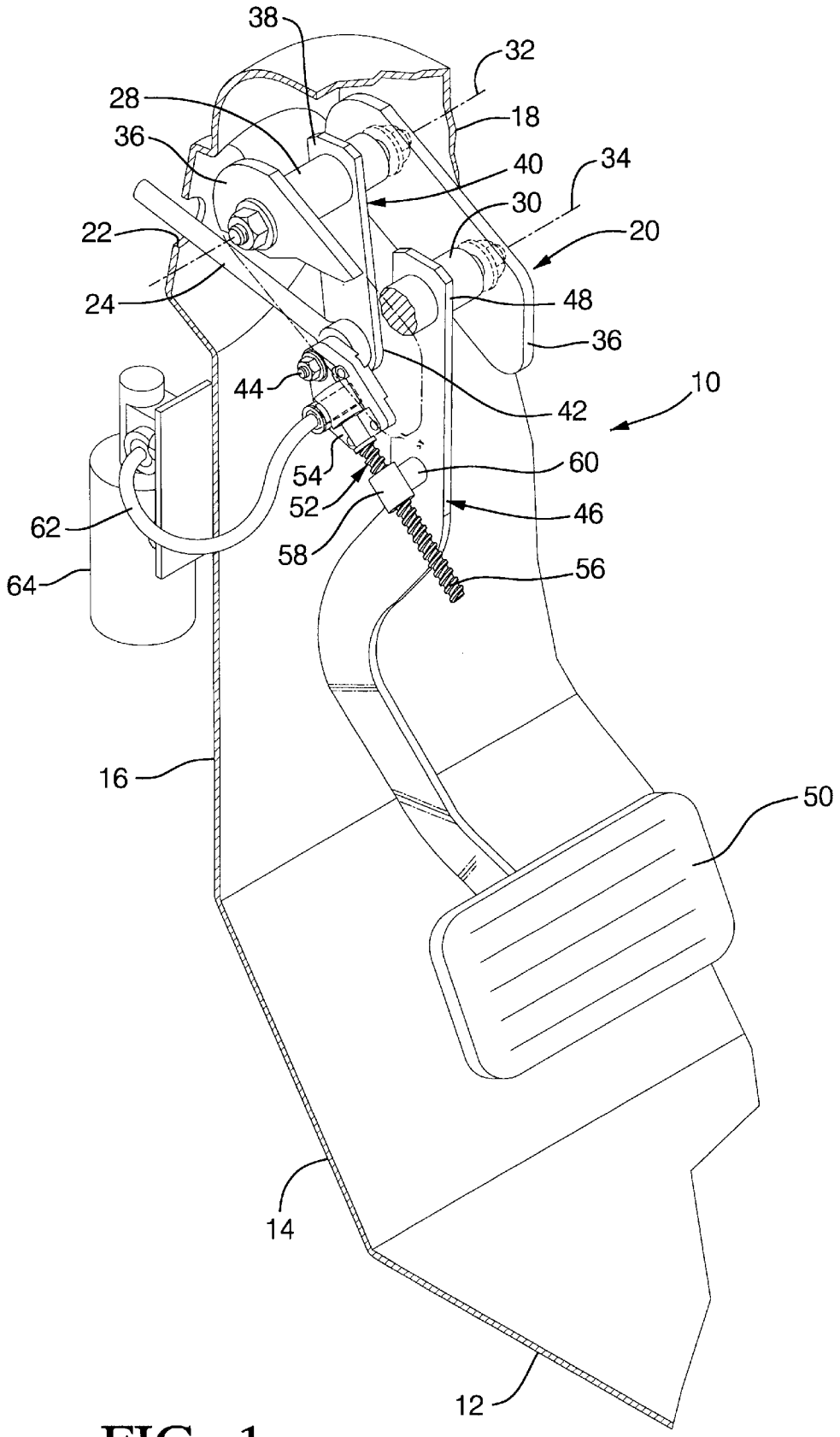
FIG. 1 is a fragmentary perspective view of an adjustable pedal mechanism according to the invention.

Referring now to the drawings in detail, numeral 10 generally indicates an automotive vehicle body having an enclosure including a floor 12, toe panel 14, dash panel 16, and upper side mounting panel 18. These portions of the body comprise a support portion of an adjustable pedal mechanism 20 to be subsequently described. Alternatively, the mechanism 20 could be mounted to separate bracket means to form a module installable in a vehicle body as a separate pre-mounted mechanism, or support for the mechanism could be provided by any other suitable means.

Figure 2:
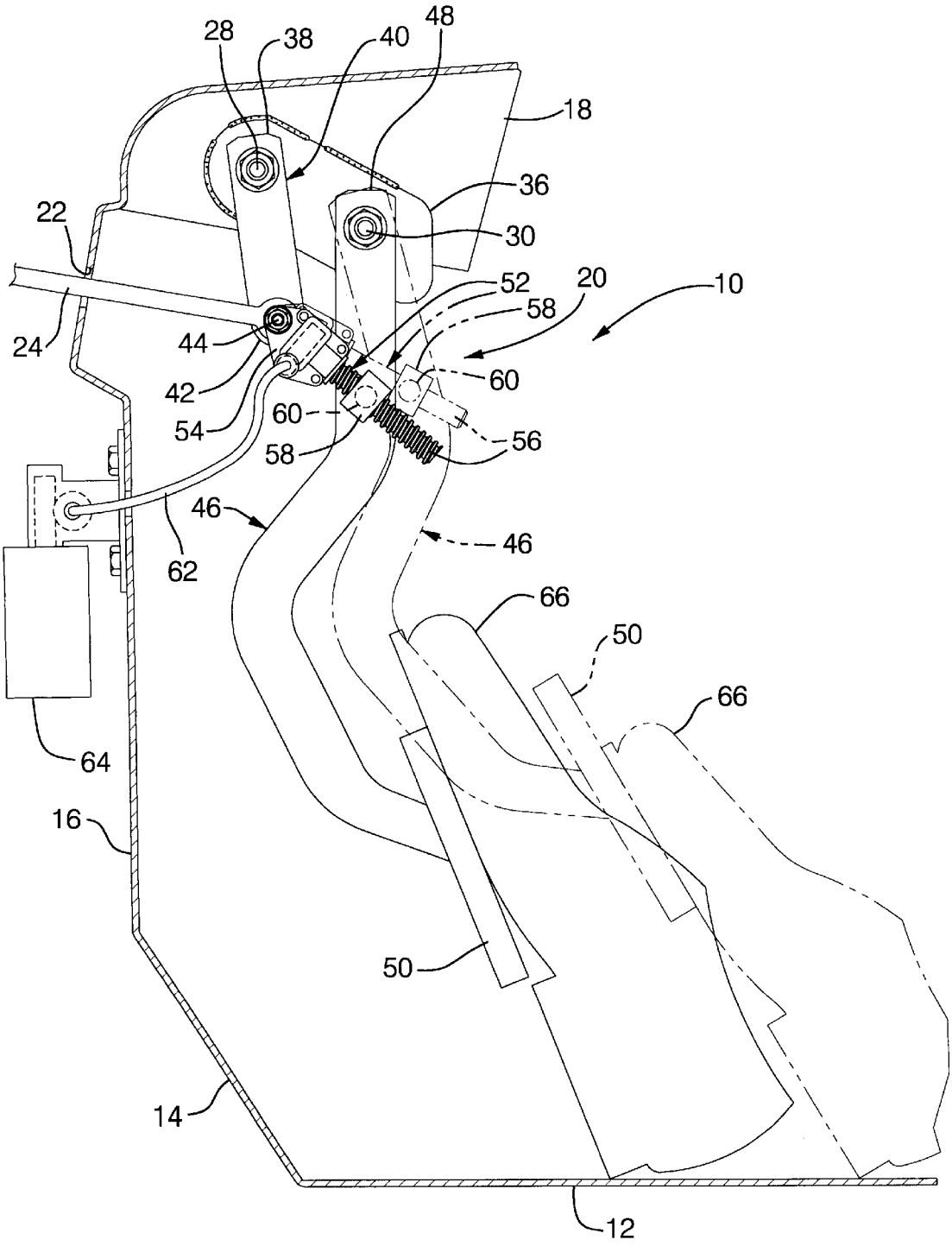
FIG. 2 is a side view illustrating the forward and rearward extreme positions of adjustment of the pedal mechanism of FIG. 1.

The dash panel 16 has an opening 22 through which extends an actuator rod 24 connected with a brake booster, clutch actuator or other device, not shown. FIGS. 1 and 2 of the drawings show the actuator rod 24 in a released position wherein it is slid to its most rearward position within the opening 22. Drawing FIG. 1 shows the pedal mechanism positioned near the forward limit of its adjustment range while FIG. 2 shows a range of adjustment of the mechanism.

The adjustable pedal mechanism 20 includes a front pivot pin 28 and a rear pivot pin 30 spaced longitudinally on parallel lateral axes 32, 34 respectively and carried by side members 36, mounted, for example by welding to the side mounting panel 18. The rear pivot pin 30 is spaced behind and below the front pin 28 so that the common plane of their axes 32, 34 slopes downward toward the rear of the vehicle.

The front pivot pin 28 pivotally supports an upper end 38 of a slave lever generally indicated by numeral 40. Slave lever 40 extends downward to a lower end 42 carrying a lower pivot pin 44. The actuator rod 24 is pivotally mounted on pin 44 and is axially movable by pivotal motion of the slave lever 40 to control an associated vehicle brake or clutch, not shown.

A pedal lever 46 has an upper end 48 pivotally mounted on the rear pivot pin 30. Lever 46 extends downward beyond the extent of the slave lever to a lower end on which is fixedly mounted a foot pedal 50. An adjustable link 52 pivotally connects a point on the pedal lever intermediate its ends with the lower end 42 of the slave lever 40. Link 52 includes a gear drive 54 pivotally mounted on the lower pivot pin 44 of the slave lever 40 and drivably connected with a ballscrew 56 engaging a nut 58 that is pivotally supported on a pivot 60 located at said intermediate point on the pedal lever 46.

The ballscrew 56 is selectively rotatably driven by the gear drive 54 that is in turn driven through a cable 62 by a gear motor 64 mounted on the front surface of the front panel 16. Rotation of the ballscrew 56 by the gear drive 54 varies the effective length of the link 52 and thus changes the angular position of the pedal lever 46 relative to the slave lever 40, moving the position of the foot pedal 50 fore or aft in the body 10 to a desired position for actuation by each of various vehicle drivers.

FIG. 2 best illustrates the operation of the mechanism as pertains to its fore and aft adjustment by the adjustable link 52 The figure shows in solid lines a forward position of the mechanism wherein the link 52 has been shortened by rotation of the ballscrew 56, causing the pedal lever 46 to be pivoted to a forward position and the foot pedal 50 to be positioned at a relatively close point to the toe panel 14. Note that the pedal 50 is positioned at a convenient height above the floor to be easily accessible to a driver's foot indicated by numeral 66.

To adjust the position of the foot pedal rearward, the gear motor 64 is actuated to rotate the ballscrew 56 and swingably pivot the pedal lever 46 rearwardly to any selected position within the range of the mechanism, for example to the aft position which is indicated in phantom lines in FIG. 2. In this aft position, the foot pedal 50 is moved a significant amount rearward but is moved only a small amount upward from the floor and presents to the driver's foot an attitude only slightly changed from the position of the foot pedal in the forward position.

The levers 40, 46 and adjustable link 52, lying generally parallel with the plane of the front and rear pivots, form a parallelogram linkage with the link side being of variable length to vary the initial angular position of a foot pedal 50 at the lower end of the pedal lever 46. The lowered rearward location of the pedal lever 46 allows a greater variation of the pedal 50 position without excessively raising the pedal height while the parallelogram linkage arrangement maintains pedal actuating travel essentially constant at all locations within the range of adjustment positions.

Figure 3:
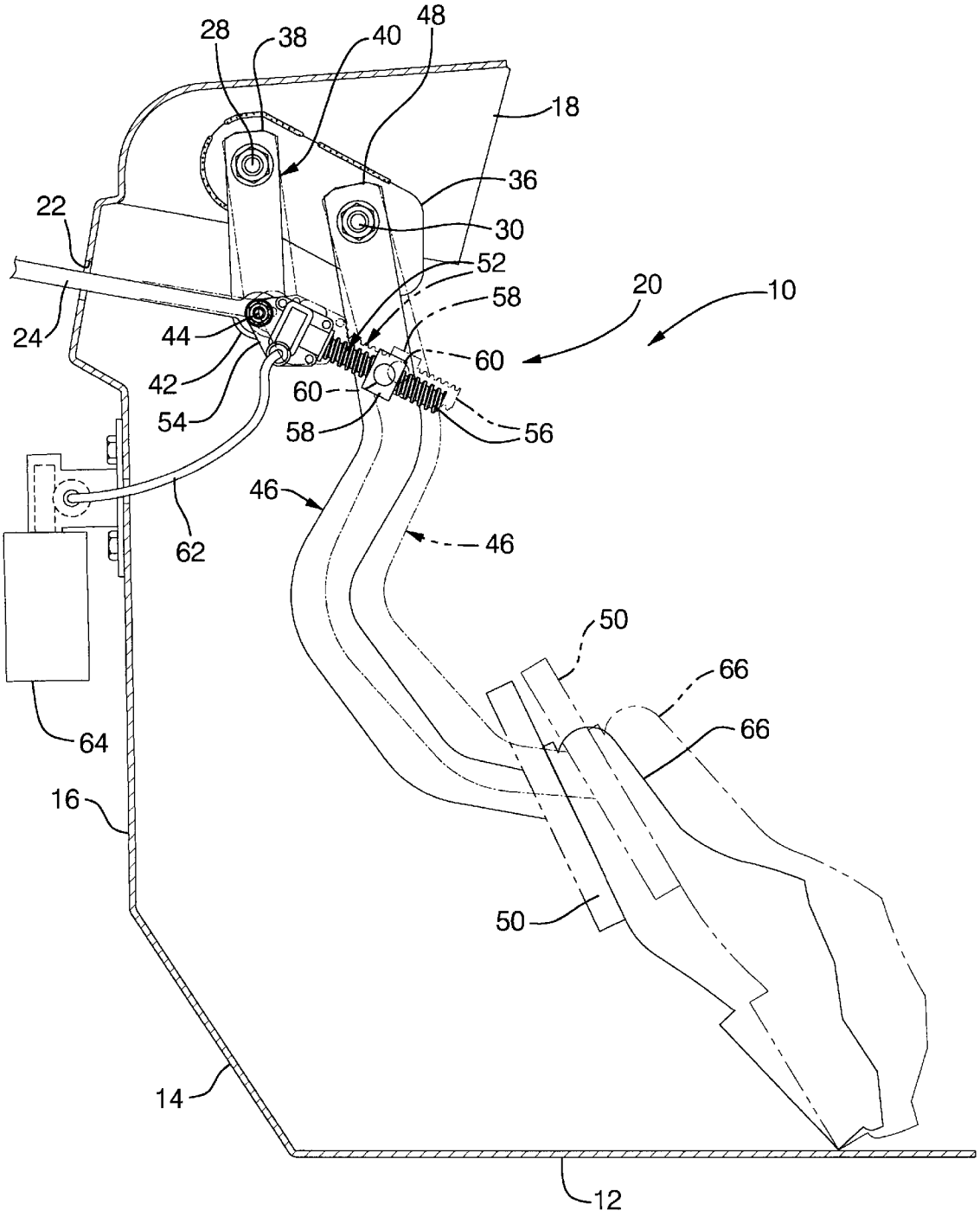
FIG. 3 is a view similar to FIG. 2 illustrating the actuating positions of the pedal in its rear position of operation.

FIG. 3 illustrates the operation of the adjustable pedal mechanism 20 in its movement of the actuator rod 24 between rear and forward positions as the driver's foot 66 presses forward on the foot pedal 50. The mechanism 20 is shown in solid lines in the forward position with the adjustable link extended in a generally rearward adjustment position. Note that in this forward position, the slave lever 40 is pivoted clockwise so that the actuator rod 24 is moved forward to a brake applied or clutch released position and the foot pedal 50 is pushed forward to its forward position. As the driver's foot 66 is moved rearward, the pedal reaches the released position shown in phantom lines in FIG.3. In this released position, the pedal lever 46 has been pivoted counterclockwise, allowing the link 52 to move rearward and the slave lever 40 to pivot counterclockwise to relax the force on the actuator rod 24 which is moved rearward by means, not shown, in the brake booster or other device.

Thus the mechanism of the current invention is shown to provide a relatively large range of fore and aft adjustment of the foot pedal without causing a significant change in the attitude or height of the foot pedal throughout the range of travel. There is thus provided an improved adjustable pedal mechanism which provides for convenient adjustment of the pedal location to accommodate drivers of various leg lengths.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

We claim:

1. An adjustable pedal mechanism for an automotive vehicle, said mechanism comprising:

a support having front and rear pivots extending on laterally extending parallel axes, said rear pivot spaced behind and below said front pivot;

a slave lever having an upper end pivotally mounted on said front pivot and extending downward to a lower end;

an actuator rod for controlling a vehicle device, said rod connected with said lower end of the slave lever for causing axial actuating motion of the rod upon limited pivotal motion of the slave lever;

a pedal lever having an upper end pivotally mounted on said rear pivot and extending downward beyond the extent of said slave lever to a lower end connected to a foot pedal for pivotal actuation of the pedal lever; and an adjustable link pivotally connecting a point on said pedal lever intermediate its ends with said lower end of the slave lever, said link being of variable length and operable to vary the pivotal position of said pedal lever and thereby adjust the fore and aft location of said pedal;

said pedal being operable from any of a range of fore and aft locations to pivot the pedal lever, causing the link to pivot the slave lever to thereby axially move the actuator rod for controlling said vehicle device in a desired manner.

2. An adjustable pedal mechanism as in claim 1 wherein said link extends generally parallel with a plane defined by said parallel pivot axes and said slave lever is generally parallel with said pedal lever between its upper end and said point connected with said adjustable link, whereby the mechanism approximates a parallelogram linkage having one side of variable length to vary the initial angle of the operating range of the pedal lever while maintaining the operating travel of the pedal relatively constant.

3. An adjustable pedal mechanism as in claim 2 wherein said pedal lever between its upper end and said point connected with said adjustable link and said slave lever are exactly parallel at an intermediate point of the range of adjustment of said adjustable link in said mechanism.

4. An adjustable pedal mechanism as in claim 1 wherein said adjustable link is power operated.

5. An adjustable pedal mechanism as in claim 1 wherein said adjustable link includes a ballscrew.

6. An adjustable pedal mechanism as in claim 5 wherein said ballscrew is rotatably drivable by a gear drive connected by a cable with an electric motor drive selectably operable to vary the fore and aft position of the pedal as desired for the convenience of various vehicle drivers.

* * * * *